US007703739B2

(12) United States Patent
Judge et al.

(10) Patent No.: US 7,703,739 B2
(45) Date of Patent: Apr. 27, 2010

(54) RAM BOP SHEAR DEVICE

(75) Inventors: Robert Arnold Judge, Houston, TX (US); Dustin Dean Gass, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 156 days.

(21) Appl. No.: 11/767,984

(22) Filed: Jun. 25, 2007

(65) Prior Publication Data

US 2008/0001107 A1 Jan. 3, 2008

Related U.S. Application Data

(63) Continuation-in-part of application No. 10/979,090, filed on Nov. 1, 2004, now Pat. No. 7,234,530.

(51) Int. Cl.
*E21B 33/06* (2006.01)

(52) U.S. Cl. ..... 251/1.3; 251/1.1; 166/55

(58) Field of Classification Search ..... 251/1.1, 251/1.3; 166/55

See application file for complete search history.

(56) References Cited

U.S. PATENT DOCUMENTS

| | | | |
|---|---|---|---|
| 3,273,855 | A | 9/1966 | Wells |
| 3,561,526 | A | 2/1971 | Williams, Jr., et al. |
| 3,817,326 | A | 6/1974 | Meynier, III |
| 4,043,389 | A | 8/1977 | Cobb |
| 4,081,027 | A | 3/1978 | Nguyen |
| 4,132,266 | A | 1/1979 | Randall |
| 4,132,267 | A | 1/1979 | Jones |
| 4,240,503 | A | 12/1980 | Holt, Jr. et al. |
| 4,313,496 | A | 2/1982 | Childs et al. |
| 4,323,117 | A | 4/1982 | Pierce |
| 4,341,264 | A | 7/1982 | Cox et al. |
| 4,347,898 | A | 9/1982 | Jones |
| 4,349,175 | A | 9/1982 | Akkerman et al. |
| 4,508,313 | A | 4/1985 | Jones |
| 4,523,639 | A | 6/1985 | Howard, Jr. |
| 4,537,250 | A | 8/1985 | Troxell, Jr. |
| 4,540,046 | A | 9/1985 | Granger et al. |
| 4,554,976 | A | 11/1985 | Hynes et al. |
| 4,580,626 | A | 4/1986 | Jones |
| 4,612,983 | A | 9/1986 | Karr, Jr. |
| 4,646,825 | A | 3/1987 | Van Winkle |
| 4,671,312 | A | 6/1987 | Bruton |
| 4,911,410 | A | 3/1990 | Baker |
| 4,997,162 | A | 3/1991 | Baker et al. |
| 5,163,655 | A | 11/1992 | Chickering, III et al. |
| 5,360,061 | A | 11/1994 | Womble |
| 5,370,362 | A | 12/1994 | Kent et al. |

(Continued)

*Primary Examiner*—John K Fristoe, Jr.
(74) *Attorney, Agent, or Firm*—Potomac Patent Group PLLC

(57) ABSTRACT

A ram-type blowout preventer includes a first ram block having a first shearing element and a first sealing element, a second ram block opposing the first ram block and having a second shearing element and a second sealing element, a load intensifying member coupled to the first ram block, wherein the load intensifying member is a stiff cantilever beam, a receptacle of the second ram block to receive the load intensifying member when the first ram block and the second ram block close together, and shims between a top surface of the load intensifying member and a top surface of the receptacle. The load intensifying member is configured to apply a spring force when the load intensifying member is engaged within the receptacle.

22 Claims, 4 Drawing Sheets

U.S. PATENT DOCUMENTS

| | | | |
|---|---|---|---|
| 5,400,857 | A | 3/1995 | Whitby et al. |
| 5,501,424 | A | 3/1996 | Williams et al. |
| 5,515,916 | A | 5/1996 | Haley |
| 5,645,098 | A | 7/1997 | Morrill |
| 5,803,431 | A | 9/1998 | Hoang et al. |
| 6,173,770 | B1 | 1/2001 | Morrill |
| 6,223,819 | B1 | 5/2001 | Heinonen |
| 6,244,336 | B1 | 6/2001 | Kachich |
| 6,454,015 | B1 | 9/2002 | Armstrong et al. |
| 6,455,015 | B1 | 9/2002 | Kilroy |
| 6,554,247 | B2 | 4/2003 | Berckenhoff et al. |
| 6,637,516 | B1 | 10/2003 | Boyd |
| 6,651,746 | B2 | 11/2003 | Boyd |

RAM BOP SHEAR DEVICE

CROSS-REFERENCE TO RELATED APPLICATIONS

This application claims the benefit, pursuant to 35 U.S.C. §120, as a continuation-in-part application of U.S. patent application Ser. No. 10/979,090 filed on Nov. 1, 2004, which is expressly incorporated by reference in its entirety.

BACKGROUND OF INVENTION

1. Field of the Invention

The invention relates generally to blowout preventers used in the oil and gas industry. Specifically, the invention relates to a blowout preventer with a novel shear load intensifying mechanism.

2. Background Art

Well control is an important aspect of oil and gas exploration. When drilling a well, for example, in oil and gas exploration applications, devices must be put in place to prevent injury to personnel and equipment associated with the drilling activities. One such well control device is known as a blowout preventer ("BOP").

BOP's are generally used to seal a wellbore in the event of a "blowout." For example, drilling wells in oil or gas exploration involves penetrating a variety of subsurface geologic structures, called "formations" or "layers." Each layer generally comprises a specific geologic composition such as, for example, shale, sandstone, limestone, etc. Each layer may contain trapped fluids or gas at different formation pressures, and the formation pressures generally increase with increasing depth. The working pressure of the drilling fluid in the wellbore is generally adjusted to at least balance the formation pressure by, for example, increasing a density of the drilling fluid in the wellbore or increasing pump pressure at the surface of the well.

There are occasions during drilling operations when a wellbore may penetrate a layer having a formation pressure substantially higher that the pressure maintained in the wellbore. When this occurs, the well is said to have "taken a kick." The pressure increase associated with the kick is generally produced by an influx of formation fluids (which may be a liquid, a gas, or a combination thereof) into the wellbore. The relatively high pressure kick tends to propagate from a point of entry in the wellbore uphole (from a high pressure region to a low pressure region). If the kick is allowed to reach the surface, drilling fluid, well tools, and other drilling structures may be blown out of the wellbore. These "blowouts" often result in catastrophic destruction of the drilling equipment (including, for example, the drilling rig) and in substantial injury or death of rig personnel.

Because of the risk of blowouts, BOP's are typically installed at the surface or on the sea floor in deep water drilling arrangements so that kicks may be adequately controlled and "circulated out" of the system. BOP's may be activated to effectively seal in a wellbore until measures can be taken to control the kick. There are several types of BOP's, the most common of which are annular blowout preventers and ram-type blowout preventers.

Annular blowout preventers typically comprise annular elastomer "packers" that may be activated (e.g., inflated) to encapsulate drillpipe and well tools and completely seal the wellbore. A second type of the blowout preventer is the ram-type blowout preventer. Ram-type preventers typically comprise a body and at least two oppositely disposed bonnets, Interior of each bonnet is a piston actuated ram. The rams may be pipe rams (or variable pipe rams) (which, when activated, move to engage and surround drillpipe and well tools to seal the wellbore), shear rams (which, when activated, move to engage and physically shear any drillpipe or well tools in the wellbore), or blind rams. The rams are typically located opposite of each other and, whether pipe rams or shear rams, the rams typically seal against one another proximate a center of the wellbore in order to completely seal the wellbore.

In some cases, flexible materials that are located within a central bore of a BOP will "snake" around the shearing elements on shear rams. When this occurs, the flexible materials may not be fully sheared by the rams when the BOP is energized and the rams closed.

U.S. Pat. No. 5,515,916 ("Haley") discloses rams for blowout preventers having blades on their inner ends in position to shear or sever a pipe or other object extending within the bore of the preventer housing. The rams of the BOP further comprise load intensifying pins which force packers into sealing engagement with the rams.

Often, separation forces between the ram blocks in a BOP may become extremely high. Features of the BOP not sturdy enough to handle such forces may be permanently deformed, rendering these features useless. Thus, what is needed is a BOP with robust ram blocks and features that will effectively shear both rigid and flexible materials that are located in a central bore of the BOP.

SUMMARY OF INVENTION

In one aspect, the present disclosure relates to a ram-type blowout preventer including a first ram block having a first shearing element and a first sealing element and a second ram block opposing the first ram block and having a second shearing element and a second sealing element. The ram-type blowout preventer also includes a load intensifying member coupled to the first ram block, wherein the load intensifying member is a stiff cantilever beam and a receptacle of the second ram block to receive the load intensifying member when the first ram block and the second ram block close together. The ram-type blowout preventer also includes shims between a top surface of the load intensifying member and a top surface of the receptacle. The load intensifying member is configured to apply a spring force when the load intensifying member is engaged within the receptacle.

In another aspect, the present disclosure relates to a ram-type blowout preventer including a first ram block having a first shearing element and a first sealing element and a second ram block opposing the first ram block and having a second shearing element and a second sealing element. The load intensifying member is a stiff cantilever beam and a receptacle of the second ram block is configured to receive the load intensifying member when the first ram block and the second ram block close together. The load intensifying member and the receptacle are configured so that the spring force increases as the first ram block engages the second ram block.

In another aspect, the present disclosure relates to a ram-type blowout preventer including a first ram block having a first shearing element and a first sealing element and a second ram block opposing the first ram block and having a second shearing element and a second sealing element. The ram-type blowout preventer also includes a load intensifying member coupled to the first ram block, wherein the load intensifying member is a stiff cantilever beam and a receptacle of the second ram block to receive the load intensifying member when the first ram block and the second ram block close together. The ram-type blowout preventer also includes shims located upon at least one of a top surface of the load intensifying member and a top surface of the receptacle. The load intensifying member and the receptacle are configured so that a spring force increases as the first ram block engages the second ram block and the load intensifying member is engaged within the receptacle.

Other aspects and advantages of the invention will be apparent from the following description and the appended claims.

DETAILED DESCRIPTION

Embodiments of the present invention relate to a ram block that includes a load intensifying member coupled to the ram block. Other embodiments may relate to a BOP with a load intensifying member that is coupled to a ram block within the BOP. In this disclosure, particular embodiments of a load intensifying member are disclosed and described as a "pin." This is only one example of such a member, and the invention is not intended to be so limited.

Figure 1:
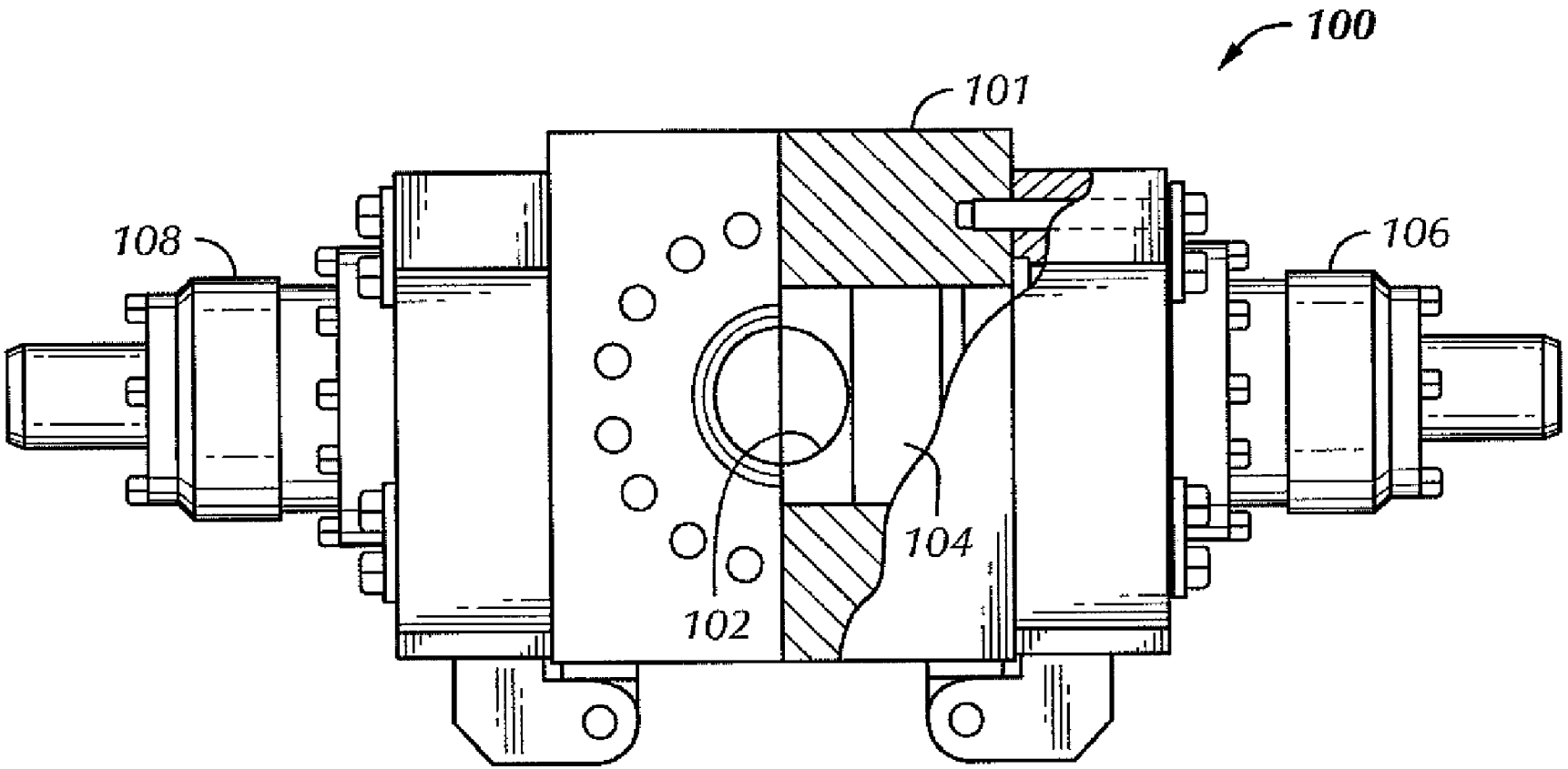
FIG. 1 shows a partial cutaway top view of a ram-type BOP.

FIG. 1 shows a top view cutaway of a typical ram-type blowout preventer 100 ("BOP"). During normal drilling and well operations, the BOP remains open. The drill string (not shown) and other well tools are lowered into the well through the center bore 102 of the BOP 100, which is generally mounted on the top of the well (not shown).

The BOP 100 includes a body 101 and two oppositely positioned bonnets 106, 108. The bonnets 106, 108 house the piston mechanisms that drive the ram blocks to a closed position in the event of a blowout. The BOP 100 includes two ram blocks. Only one ram block 104 is shown in the cutaway of FIG. 1, but it will be understood that the BOP 100 includes at least one other ram block for engaging and sealing with the first ram block 104.

The BOP 100 in FIG. 1 includes shear ram blocks (e.g., ram block 104). When the BOP is actuated, the ram blocks in the BOP are forced together. As the ram blocks converge, shearing elements on the ram blocks shear any materials or tools in the center bore 102 of the BOP 100. Once the material and tools (not shown) in the center bore 102 are sheared, sealing elements on the ram blocks engage to seal the pressure in the wellbore.

Figure 2:
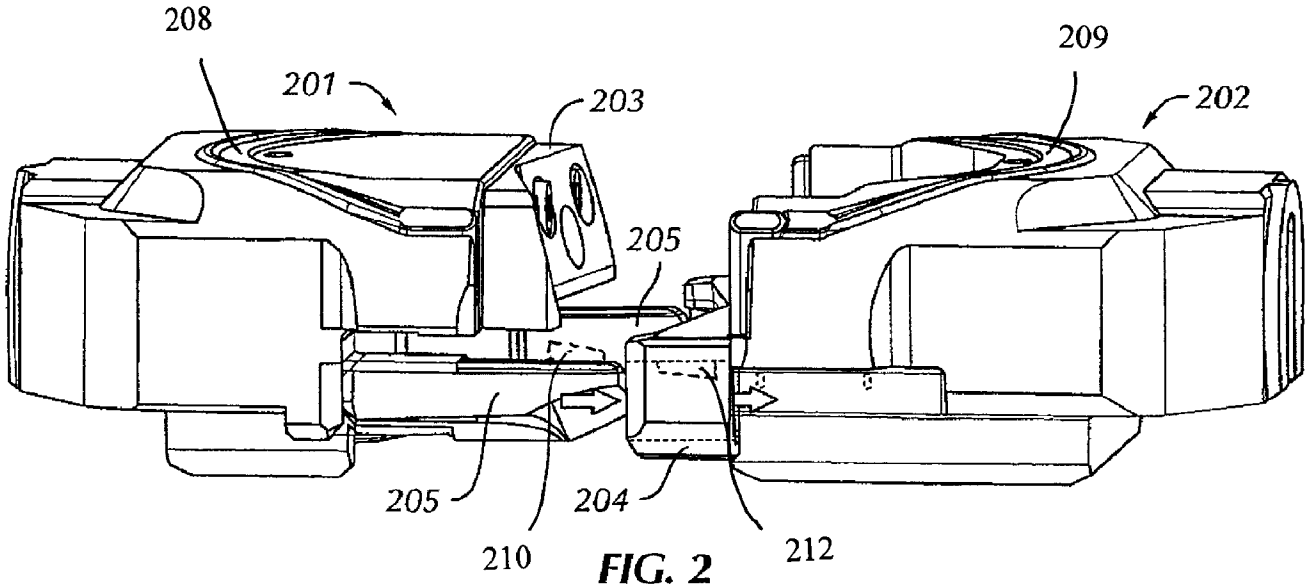
FIG. 2 is a perspective view of two ram blocks before engagement in accordance with one embodiment of the invention.

FIG. 2 is a perspective view of two ram blocks 201, 202 that may form part of a BOP (e.g., BOP 100 in FIG. 1) in accordance with embodiments of the present disclosure. Ram blocks 201, 202 are shown separate from a BOP for case of understanding. Second ram block 202 includes a connector 211 where the ram block 202 may be connected to a driving rod or piston (not shown) or other device for forcing the ram block 202 into a closed position. A similar connector (not shown) may be present on the first ram block 201.

Still referring to FIG. 2, ram blocks 201, 202 comprise shear elements 203, 204, respectively, which are attached to a vertical face of each ram block 201, 202. Shear elements 203, 204 are configured to engage when the BOP is in a closed position thereby shearing any piping or tools in the wellbore as well as sealing it off. Further, the ram blocks 201 and 202 include seal elements 208 and 209. Furthermore, first ram block 201 comprises load intensifying members 205 configured to engage rectangular receptacles (not shown) on ram block 202. While receptacles are described as rectangular, other appropriate configurations may be used as well.

Figure 3:
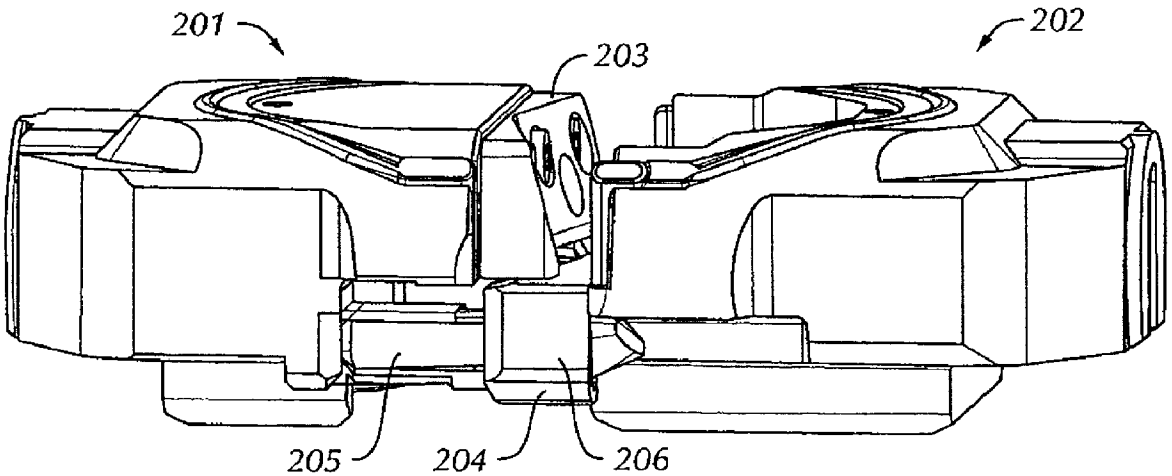
FIG. 3 is a perspective view of two ram blocks as they move into engagement in accordance with one embodiment of the invention.

Referring now to FIG. 3, ram blocks 201, 202 are shown as moved toward a closed or engaged position in accordance with embodiments of the present disclosure. Load intensifying member 205 of ram block 201 is shown in engagement with a receptacle 206 on ram block 202. As shown, load intensifying member 205 may comprise a stiff, cantilevered beam affixed to ram block 201 by welding or other means known to one having ordinary skill in the art. A distal end of load intensifying member 205 may have an end shaped to insure engagement with the mating receptacles in the second ram block 202.

As shown in FIG. 3, in some embodiments of ram blocks, shear element 204 on the second ram block 202 slides under the shear element 203 on the first ram block 201. Ideally, there may be contact pressure in the vertical direction between the shear elements 203, 204 when the ram blocks 201, 202 are in a closed position. In some cases, however, when a relatively flexible material (i.e., wireline cable) is located in the central bore of the BOP, the flexible material may not completely shear. For example, when a wire or cable is present in the central bore, the wire may snake around the shearing element 203, 204, and the shear of the wire will be incomplete. In such cases, the wire, as it snakes around the shear elements 203, 204, will push the shear elements 203, 204 apart and occupy the space in between.

In the event of an incomplete shear of material in the central bore of a BOP, the material cannot be moved from between the sealing elements of the opposing ram blocks. Thus, only an incomplete seal may be formed between the ram block. This represents a potential danger in the event of a blowout.

A load intensifying member 205, according to certain embodiments of the invention, may enable a proper shear of flexible materials. The load intensifying member 205 is coupled to the first ram block 201 so that it will engage with the second ram block 202 when the ram blocks 201, 202 are moved into a closed position.

Figure 4:
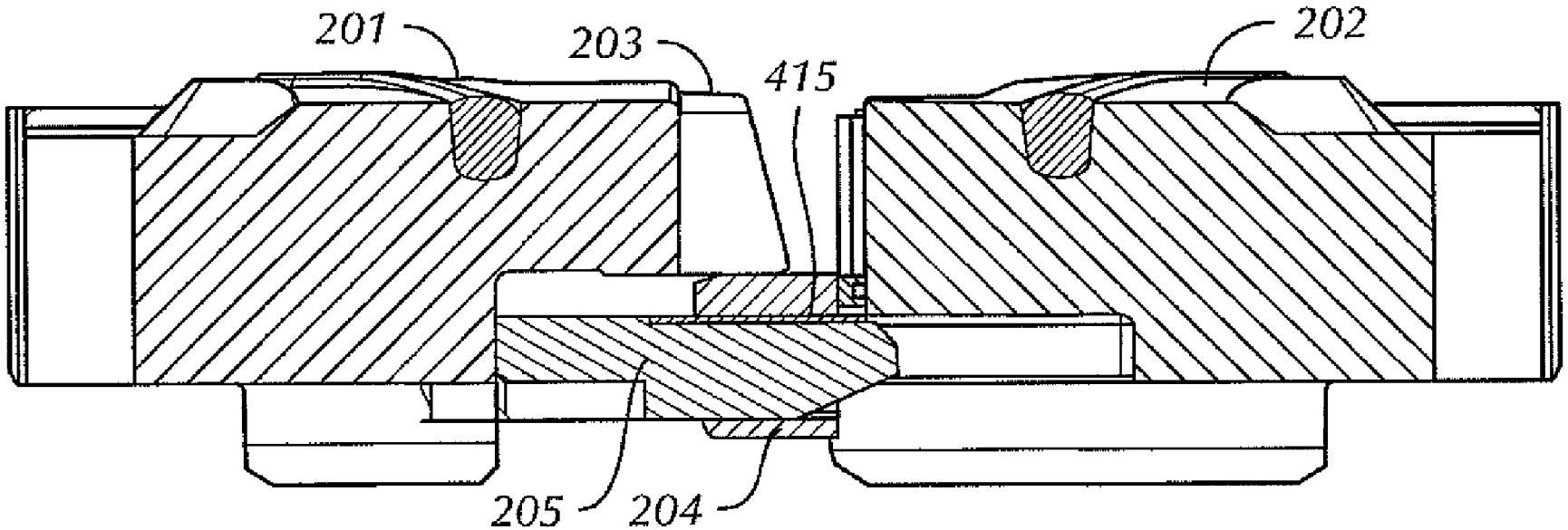
FIG. 4 is a cross-section view of two ram blocks of FIG. 3.

In the embodiment shown in FIG. 4, the load intensifying member 205 engages with the second ram block 202 at an engagement surface 415. The engagement of the load intensifying member 205 and the second ram block 202 creates a downward force on the load intensifying member 205, and thus also on the first ram block 201, and it creates a corresponding upward force on the second ram block 202. The forces push the shear element 204 of the second ram block 202 and the shear element 203 of the first ram block 201 together. The load intensifying member 205 "intensifies" the load between the shear elements 203, 204.

As such, the amount of downward force acting on load intensifying member 205 may be characterized as the amount of displacement of load intensifying member 205 multiplied by a spring constant k of load intensifying member 205. Spring constant k is a function of the length, cross-sectional area, and material composition of load intensifying member 205 and may be selected (by varying the geometry and composition of intensifying member 205) to result in a desired amount of force to keep first ram block 201 and second ram block 202 together.

Furthermore, it should be understood that the geometry of load intensifying member 205 may be such that no single spring constant k exists. Particularly, load intensifying member 205 may be constructed so that the spring "constant" varies along the length of load intensifying member 205 as a function of distance to result in varying downward force as it is engaged within second ram block 202. Alternatively, load intensifying member 205 may be constructed with a single, constant, k value, but be designed such that is displaces more (or less) as it engaged within second ram block 202.

It is noted that other embodiments may include a load intensifying member that engages with an opposing ram block to create an upward force on the member and a downward force on the opposing ram block. The particular direction of the force is not intended to limit the invention.

The load intensifying member 205 prevents vertical separation between the shear elements 203, 204. In fact, in certain embodiments, a load intensifying member 205 will increase the load between the shear elements 203 204. This creates a "scissor effect" that will effectively shear even flexible materials that are positioned in the central bore of the BOP.

In certain embodiments of the invention, a load intensifying member or pin may have a length that is selected so that it will not engage with an opposing ram block until after there is vertical overlap between shear elements. In other embodiments, a load intensifying pin has a length selected so that it will not engage with an opposing ram block until after there is contact between the shearing elements on the opposing ram blocks.

Figure 5:
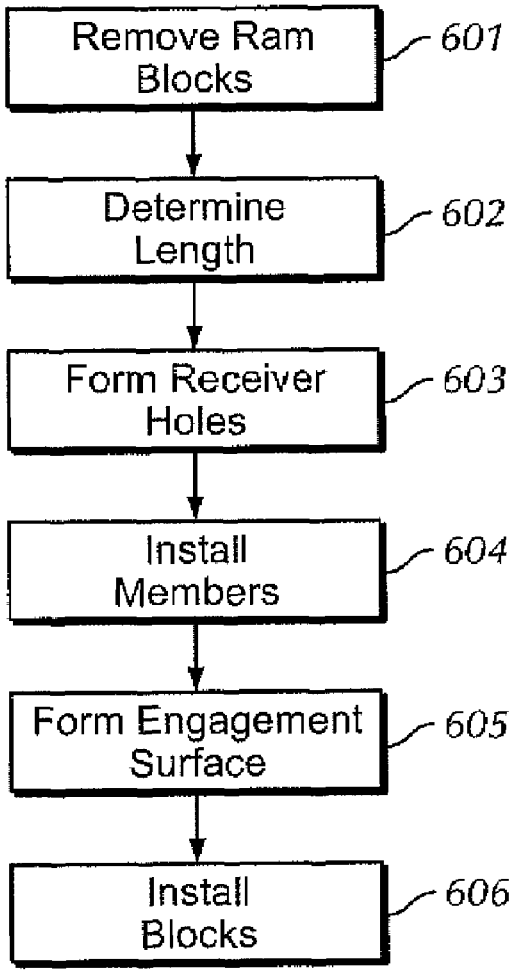
FIG. 5 shows a method in accordance with one embodiment of the invention.

FIG. 5 shows an embodiment of a method in accordance with the invention. A method for re-fitting the ram blocks of an existing BOP may include removing the ram blocks from the BOP, at step 601. In some cases, the ram blocks may be removed by others and transported to a re-fitting facility. Thus, the step of removing the ram blocks is not required by all embodiments of the invention.

In addition, some BOP designs enable access to the ram blocks, without having to remove the ram blocks from the BOP. For example, one such BOP is disclosed in U.S. Pat. No. 6,554,247, assigned to the assignee of the present invention, and incorporated by reference herein. In such cases, the ram blocks may be modified without removing the ram blocks from the BOP.

Next, the method may include determining the desired length for one or more load intensifying members to be installed in the existing BOP, at step 602. Is some embodiments, the desired length corresponds to a length that will enable the shearing of non-flexible items, such as a pipe, in the central bore of the BOP before the load intensifying pins engage the opposing ram block.

Next, the method may include forming one or more receiver holes in a ram block, at step 603. The receiver holes receive the load intensifying members that are being installed on the ram blocks of an existing BOP. Such receiver holes must be formed in a position so that the load intensifying members, when installed, will properly engage an opposing ram block.

Next, the method may include installing one or more load intensifying members in a ram block, at step 604. The load intensifying members may be coupled to a ram block in any manner known in the art. In addition, the load intensifying members may comprise pins. For example, load intensifying pins may be installed in receiver holes that have been formed in the ram block (such as in step 603, if included). The load intensifying pins may be installed on a ram block so that they force a shearing element on the ram block together with a second shearing element on an opposing ram block. In some embodiments, two or more load intensifying pins may be installed on a ram block. In at least one embodiment, one load intensifying pin is installed on one ram block, and a second load intensifying pin is installed on an opposing ram block. The pins operate cooperatively to increase the load between the shearing elements and create a scissor effect.

Next, the method may include forming one or more engagement surfaces on an opposing ram block, at step 605. A engagement surface is positioned to engage with a load intensifying pin when the ram blocks are moved to a closed position. In some embodiments, the engagement surfaces are formed at a slope so that the load between the hearing elements will increase as the ram blocks move closer together.

Finally, the method may include installing the ram blocks into a BOP, at step 606. The ram blocks may be installed in the BOP from which they were removed, or, in some cases, the ram blocks may be installed in another suitable BOP.

It is noted that ram blocks are generally interchangeable parts for a BOP. That is, the ram blocks may be removed and replaced on an existing BOP at regular intervals. In addition, one particular type of ram block may be adapted to fit into more than one BOP. For example, it is common to install multiple BOP's in a BOP stack. By using similar BOP's, it enables a ram block to be used in more than one BOP. Accordingly, the method of refitting an existing ram block should not be construed to exclude a ram block that is stored as a "spare," even though such a ram block was not removed from an existing BOP. However, it should be understood that when moving blocks from one BOP to another, the gap between the load intensifying members and the corresponding receptacles may need to be re-evaluated, as the tolerance stack-up will have changed and different thickness shims may be required.

Certain embodiments of the invention may present one or more of the following advantages. A BOP with at least one load intensifying pin may more effectively shear flexible materials that are positioned in the central bore of the BOP. Advantageously, certain embodiments may enable the shearing of rigid materials before a load intensifying pin engages an opposing ram bock. This will enable a BOP to shear rigid materials without the added friction and force that is created by a load intensifying pin. In such embodiments, the increase in friction and closing force is experienced after any rigid materials have been successfully sheared.

Figure 6:
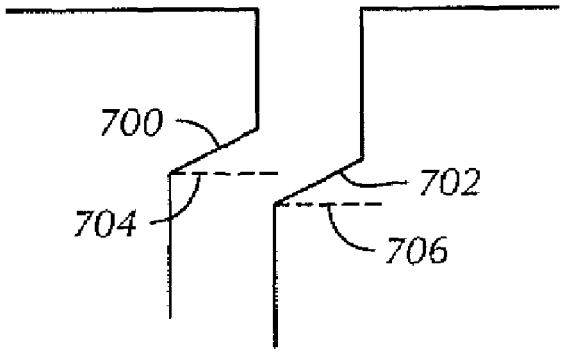
FIG. 6 shows an apparatus in accordance with an embodiment of the invention.

FIG. 6 shows a cross-section of a first ram block and a second ram block in accordance with an embodiment of the invention, wherein the load intensifying member serves as a mechanism for establishing vertical load to assist in sealing the BOP (in addition to or instead of the shearing function discussed above). In this embodiment, vertically opposed first engagement surface 700 disposed on a first ram bock and second engagement surface 702 disposed on a second ram block (which are shown as sloped, but may also be horizontal (shown as 704 and 706)) form a sealing surface when engaged by the load intensifying member, upon actuation of the blowout preventer. Those having ordinary skill in the art will appreciate that the vertical load added by the load intensifying member may cause a metal-to-metal seal to form between the first engagement surface 700 and the second engagement surface 702. In this embodiment, therefore, the load intensifying member serves to assist in the sealing aspect of a BOP.

Embodiments of the present disclosure may provide several advantages to blowout preventers. The load intensifying member of the present disclosure provides a stiff cantilever member capable of withstanding very large bending loads.

The feature may shear thin wirelines, etc., which, because the wirelines are not rigid, tend to bend-over between the shear elements when shearing, causing vertical separation between the shear elements as well as failure to shear. Attempts at minimizing the vertical separation between shear elements have failed in the past due to very high separation forces plastically deforming the load intensifying member under the load therefore rendering it ineffective.

Embodiments of the present disclosure comprise load intensifying members which may be characterized as stiff cantilever members. Increasing the section modulus of the cantilever member may advantageously enable the load intensifying member to resist deformation while withstanding high separation forces.

Further, embodiments of the present disclosure may use shims to compensate for variations in the tolerance stack-up between ram blocks when assembled. Thus, in using a variety of shim configurations and sizes, the cantilever members and their associated receptacles for the ram blocks may be properly aligned. In other embodiments, the shims may be used to impart a variable downward force to keep shear elements together when cutting. It should be understood by those of ordinary skill that the shims may comprise multiple shims of different thickness or may be tapered. In one selected embodiment, a thickest shim may be located proximate to the base of the cantilevered member. In an exemplary embodiment shown in FIG. 2, a shim 210 may be placed on a top surface of the load intensifying member 205 and/or a shim 212 may be placed a top surface of the receptacle 204.

Additionally, the shims may extend for the entire length of the cantilevered member, or for only a portion of the cantilevered member. In one embodiment, the shims may extend along the cantilevered member only for a length substantially equal to the diameter of the article in the bore to be sheared. Furthermore, the shims may take different forms known in the art including, but not limited to, plates, rectangular tubes, and channels.

In yet another embodiment, the shims may be spring members themselves, thereby applying a spring force to the cantilever member. While the spring force from such shims may be relatively small compared to the spring force of the stiff cantilever member itself, spring shims may advantageously stabilize shear blades of the ram block as the rams are closed. In selected embodiments, the spring shims may comprise cupped shims, Belleville washers, or a cupped channel configured to provide a spring force between the ram blocks.

Embodiments of the present disclosure use receptacles in the lower shear element installed on a ram block to capture the load intensifying member (cantilever beam) which is mounted on the opposite ram block and maintain a predefined maximum gap. A spring force (i.e., k*displacement) may be created in the stiff cantilever member or may be created by using shims installed on the extension. Thus, the cantilever member may include a spring factor $k_1$ in a direction of a vertically-oriented plane which may be linear or non-linear over an effective range of displacement. Further, the shims may additionally comprise a second spring factor $k_2$ such that the combination of $k_1$ with $k_2$ may result in the overall spring factor k.

The size of each shim used may be related to the stack-up of measured machined tolerances for each set of ram blocks and shear elements. By installing the appropriately-sized shim, the spring force may be applied from the moment the load intensifying member engages the receptacles in the lower shear element, thus resisting any separation force created by the member being sheared. Installation of the shims effectively provides an adjustable shear element clearance mechanism at the point of shear.

The gap between the top of the load intensifying member and an upper surface of the receptacle in the lower shear element may be adjusted by partially closing the BOP such that the load intensifying members are partially engaged in the mating receptacles in the lower shear element. The existing gap may be measured, as with feeler gauges or other appropriate measuring device, and an appropriate shim selected to achieve a desired gap. The shims may then be installed on the top surfaces of the load intensifying member. Alternatively, it is understood that the shims may be installed inside the receptacles of the lower shear element. Installing the proper amount of shims, the spring force may be applied from the moment the load intensifying member engages the receptacle, resisting any separation force created by the object being sheared.

Further, it is understood by one having ordinary skill in the art that due to tolerance stack-ups, the required shims on either load intensifying member (left or right) may be different thicknesses. Gaps on either side may need to be measured to ensure correct shims are inserted. Generally, the required gap may be close to less than one-half of the diameter of the largest strand of wire to be cut.

Alternatively, the load intensifying member may comprise a tapered configuration to serve the same purpose as adding shims. The tapered configuration may help the spring force be applied constantly from the moment of engagement which may further help to resist separation forces created by the object being sheared.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A ram-type blowout preventer, comprising:

a first ram block having a first shearing element and a first sealing element;

a second ram block opposing the first ram block, the second ram block having a second shearing element and a second sealing element, wherein the second shearing element is configured to shear a tool in concert with the first shearing element;

a load intensifying member coupled to the first ram block, wherein the load intensifying member is a stiff cantilever beam;

a receptacle of the second ram block to receive the load intensifying member when the first ram block and the second ram block close together;

shims between a top surface of the load intensifying member and a top surface of the receptacle; and the load intensifying member configured to apply a spring force when the load intensifying member is engaged within the receptacle.

2. The ram-type blowout preventer of claim 1, wherein the shims are positioned upon the top surface of the load intensifying member.

3. The ram-type blowout preventer of claim 1, wherein the shims are positioned upon the top surface of the receptacle.

4. The ram-type blowout preventer of claim 1, further comprising a second load intensifying member coupled to the second ram block and configured to be received into a second receptacle of the first ram block.

5. The ram-type blowout preventer of claim 1, wherein the top surface of the load intensifying member comprises a taper.

6. The ram-type blowout preventer of claim 1, wherein the load intensifying member has a selected length so that it will engage with the second ram block after at least a partial vertical overlap between the first and second shearing elements.

7. The ram-type blowout preventer of claim 1, wherein the top surface of the receptacle is sloped so that a force between the first and second shearing elements is increased as the ram blocks move toward the closed position.

8. The ram-type blowout preventer of claim 1, wherein clearance between the shear elements is adjustable.

9. The ram-type blowout preventer of claim 1, wherein the shims are configured to apply a second spring force when the load intensifying member is engaged within the receptacle.

10. A ram-type blowout preventer, comprising:

a first ram block having a first shearing element and a first sealing element;

a second ram block opposing the first ram block, the second ram block having a second shearing element and a second sealing element, wherein the second shearing element is configured to shear a tool in concert with the first shearing element;

a load intensifying member coupled to the first ram block, wherein the load intensifying member is a stiff cantilever beam; and a receptacle of the second ram block to receive the load intensifying member when the first ram block and the second ram block close together, wherein the load intensifying member and the receptacle are configured so that the spring force increases as the first ram block engages the second ram block.

11. The ram-type blowout preventer of claim 10, wherein a top surface of the load intensifying member is sloped to result in increasing spring force as it is engaged within the receptacle.

12. The ram-type blowout preventer of claim 10, wherein a top surface of the receptacle is sloped to result in increasing spring force as the load intensifying member is engaged therein.

13. The ram-type blowout preventer of claim 10, wherein a cross-sectional geometry of the load intensifying member is varied to result in increasing spring force as it is engaged within the receptacle.

14. The ram-type blowout preventer of claim 10, wherein a material composition of the load intensifying member is varied to result in increasing spring force as it is engaged within the receptacle.

15. The ram-type blowout preventer of claim 10, further comprising shims installed to a top surface of the load intensifying member to result in increasing spring force as it is engaged within the receptacle.

16. The ram-type blowout preventer of claim 10, further comprising shims installed to a top surface of the receptacle to result in increasing spring force as the load intensifying member is engaged therein.

17. A ram-type blowout preventer, comprising:

a first ram block having a first shearing element and a first sealing element;

a second ram block opposing the first ram block, the second ram block having a second shearing element and a second sealing element, wherein the second shearing element is configured to shear a tool in concert with the first shearing element;

a load intensifying member coupled to the first ram block, wherein the load intensifying member is a stiff cantilever beam;

a receptacle of the second ram block to receive the load intensifying member when the first ram block and the second ram block close together; and shims located upon at least one of a top surface of the load intensifying member and a top surface of the receptacle, wherein the load intensifying member and the receptacle are configured so that a spring force increases as the first ram block engages the second ram block and the load intensifying member is engaged within the receptacle.

18. The ram-type blowout preventer of claim 17, further comprising a second load intensifying member coupled to the second ram block and configured to be received into a second receptacle of the first ram block.

19. The ram-type blowout preventer of claim 18, further comprising second shims located upon at least one of a top surface of the second load intensifying member and a top surface of the second receptacle.

20. The ram-type blowout preventer of claim 19, whereby the shims and the second shims are selected based upon a tolerance stack-up of the ram-type blowout preventer.

21. The ram-type blowout preventer of claim 17, wherein the load intensifying member has a selected length so that it will engage with the second ram block after at least a partial vertical overlap between the first and second shearing elements.

22. The ram-type blowout preventer of claim 17, wherein the shims are configured to apply a second spring force when the load intensifying member is engaged within the receptacle.

* * * * *

UNITED STATES PATENT AND TRADEMARK OFFICE

CERTIFICATE OF CORRECTION

PATENT NO. : 7,703,739 B2
APPLICATION NO. : 11/767984
DATED : April 27, 2010
INVENTOR(S) : Judge et al.

It is certified that error appears in the above-identified patent and that said Letters Patent is hereby corrected as shown below:

In Column 3, Line 62, delete "case" and insert -- ease --, therefor.

In Column 10, Line 37, in Claim 20, delete "whereby" and insert -- wherein --, therefor.

Signed and Sealed this
Fifth Day of April, 2011

David J. Kappos

David J. Kappos
*Director of the United States Patent and Trademark Office*